US012392516B2

(12) United States Patent
Kunchala

(10) Patent No.: US 12,392,516 B2
(45) Date of Patent: Aug. 19, 2025

(54) SYSTEM AND METHOD FOR IDENTIFYING CLOGGED EVAPORATOR COIL

(71) Applicant: Carrier Corporation, Palm Beach Gardens, FL (US)

(72) Inventor: Sai Krishna Kunchala, Hyderabad (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 218 days.

(21) Appl. No.: 17/988,411

(22) Filed: Nov. 16, 2022

(65) Prior Publication Data

US 2023/0160588 A1 May 25, 2023

Related U.S. Application Data

(60) Provisional application No. 63/282,277, filed on Nov. 23, 2021.

(51) Int. Cl.

| | |
|---|---|
| ***F24F 11/38*** | (2018.01) |
| ***F24F 11/52*** | (2018.01) |
| ***F24F 11/56*** | (2018.01) |
| ***F24F 11/62*** | (2018.01) |
| ***F24F 13/22*** | (2006.01) |

(52) U.S. Cl.

CPC ..... *F24F 11/38* (2018.01); *F24F 11/52* (2018.01); *F24F 11/56* (2018.01); *F24F 13/222* (2013.01)

(58) Field of Classification Search

CPC .. F24F 11/38; F24F 11/52; F24F 11/56; F24F 11/30; F24F 13/222

See application file for complete search history.

(56) References Cited

U.S. PATENT DOCUMENTS

| | | | | |
|---|---|---|---|---|
| 5,337,576 | A | 8/1994 | Dorfman et al. | |
| 10,480,875 | B2 | 11/2019 | Metropoulos | |
| 10,486,082 | B2 | 11/2019 | Deivasigamani et al. | |
| 2004/0083029 | A1* | 4/2004 | Bicknell | G05D 23/1931 700/276 |
| 2009/0071181 | A1 | 3/2009 | Spanger | |
| 2013/0304532 | A1* | 11/2013 | Cormier | F24F 11/38 705/7.15 |
| 2019/0203976 | A1 | 7/2019 | Scott et al. | |
| 2019/0338976 | A1 | 11/2019 | Chakraborty et al. | |
| 2020/0041374 | A1* | 2/2020 | Deivasigamani | G01M 3/04 |
| 2020/0256578 | A1 | 8/2020 | Meis et al. | |
| 2021/0389026 | A1* | 12/2021 | Wu | F24F 5/0071 |

FOREIGN PATENT DOCUMENTS

| | | | | |
|---|---|---|---|---|
| CN | 100560316 | C | | 11/2009 |
| CN | 203616275 | U | | 5/2014 |
| CN | 110092488 | A | | 8/2019 |
| CN | 209744648 | U | | 12/2019 |
| CN | 214348238 | U | | 10/2021 |
| EP | 3168555 | B1 | | 11/2020 |
| IN | 202041039512 | | | 9/2020 |
| JP | 2038965 | A | * | 2/1990 |
| WO | 2018110806 | A1 | | 6/2018 |

* cited by examiner

*Primary Examiner* — Marc E Norman

(74) *Attorney, Agent, or Firm* — CANTOR COLBURN LLP

(57) ABSTRACT

A method for evaluating a heat exchanger of an air conditioning system includes measuring a pH level of a condensate of the heat exchanger and determining a condition of the heat exchanger in response to the pH level.

15 Claims, 5 Drawing Sheets

SYSTEM AND METHOD FOR IDENTIFYING CLOGGED EVAPORATOR COIL

CROSS-REFERENCE TO RELATED APPLICATIONS

This application claims the benefit of U.S. Provisional Application No. 63/282,277 filed Nov. 23, 2021, the disclosure of which is incorporated herein by reference in its entirety.

BACKGROUND

Embodiments of the present disclosure relate to the art of air conditioning systems, and more particularly, to the condition of a heat exchanger of an air conditioning system.

Most air conditioning systems typically include one or more filters operable to capture dust, dirt, debris, and other particles within the air flow of the system. However, these filters are not able to trap all of the particulate matters within the air flow. As a result, over time, this particulate matter can accumulate on the exterior of the heat exchanger, such as the fins thereof. Because this particulate matter makes the heat exchanger less efficient in absorbing heat from the air, the remainder of the air conditioning system must compensate by running at a high power and consuming more energy.

BRIEF DESCRIPTION

According to an embodiment, a method for evaluating a heat exchanger of an air conditioning system includes measuring a pH level of a condensate of the heat exchanger and determining a condition of the heat exchanger in response to the pH level.

In addition to one or more of the features described above, or as an alternative to any of the foregoing embodiments comprising operating an indicator in response to the pH level to indicate a need for service.

In addition to one or more of the features described above, or as an alternative to any of the foregoing embodiments the indicator is associated with a component of the air conditioning system that is visible by a user.

In addition to one or more of the features described above, or as an alternative to any of the foregoing embodiments the component is a thermostat.

In addition to one or more of the features described above, or as an alternative to any of the foregoing embodiments the indicator is associated with a component of the air conditioning system that is visible by a service man.

In addition to one or more of the features described above, or as an alternative to any of the foregoing embodiments measuring the pH level of the condensate of the heat exchanger is performed automatically by a pH sensor.

In addition to one or more of the features described above, or as an alternative to any of the foregoing embodiments comprising comparing the pH level to a first threshold and in response to determining that the pH level is less than the first threshold, comparing the pH level to a second threshold.

In addition to one or more of the features described above, or as an alternative to any of the foregoing embodiments in response to determining that the pH level is less than or equal to the second threshold, communicating with a remote system a need for immediate service.

In addition to one or more of the features described above, or as an alternative to any of the foregoing embodiments in response to determining that the pH level is between the first threshold and the second threshold, estimating a date by which service will be required.

In addition to one or more of the features described above, or as an alternative to any of the foregoing embodiments measuring the pH level of the condensate of the heat exchanger is performed manually.

In addition to one or more of the features described above, or as an alternative to any of the foregoing embodiments measuring the pH level of the condensate is performed using one of a pH test strip, a pH meter, and a colorimeter.

In addition to one or more of the features described above, or as an alternative to any of the foregoing embodiments determining the condition of the heat exchanger in response to the pH level further comprises comparing the pH level to a correlated table.

According to an embodiment, an air conditioning system includes a heat exchanger, a pH sensor operable to monitor a pH level of a condensate from the heat exchanger, and a controller configured to receive the pH level of the condensate from the pH sensor and compare the pH level to at least one threshold to determine a condition of the heat exchanger.

In addition to one or more of the features described above, or as an alternative to any of the foregoing embodiments comprising a condensate drain pan disposed vertically beneath the heat exchanger.

In addition to one or more of the features described above, or as an alternative to any of the foregoing embodiments the pH sensor is arranged within the condensate drain pan.

In addition to one or more of the features described above, or as an alternative to any of the foregoing embodiments the controller is further configured to operating an indicator in response to the pH level to indicate a need for service.

In addition to one or more of the features described above, or as an alternative to any of the foregoing embodiments the controller is further configured to communicate a need for immediate maintenance.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
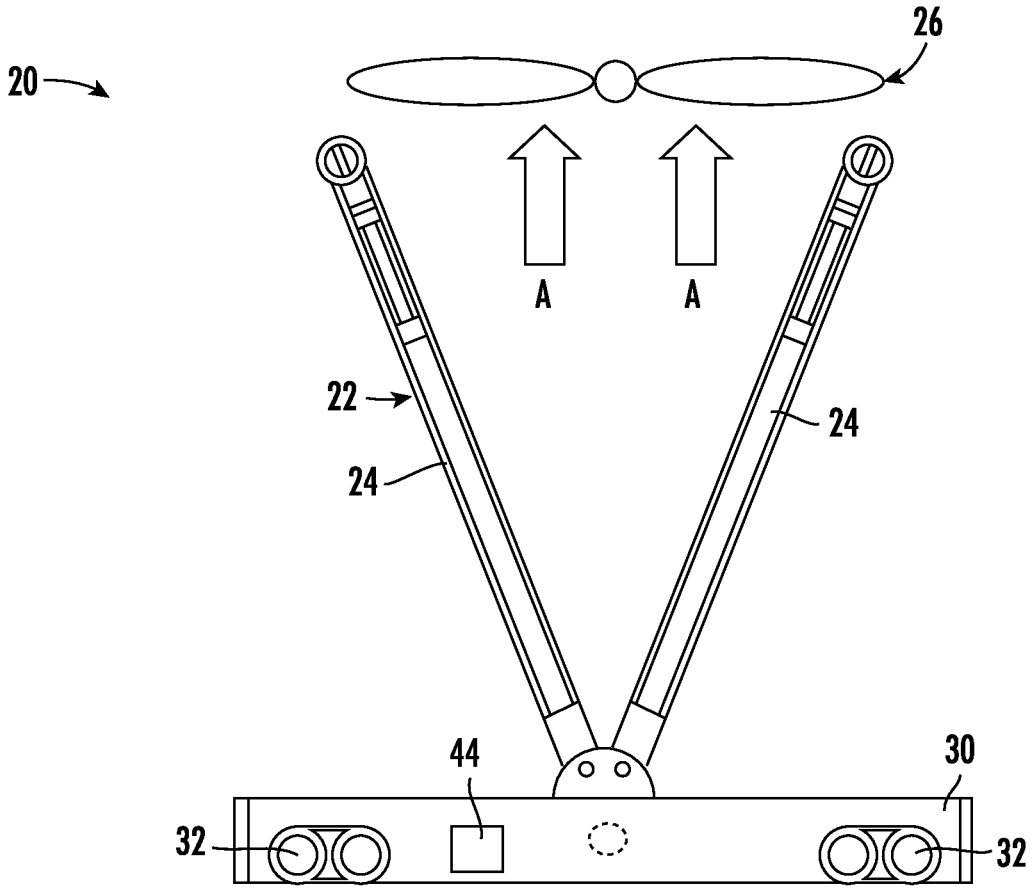
FIG. 1 is a front view of an example of a heat exchanger of an air conditioning system.

With reference now to FIG. 1, an example of a portion of an air conditioning system 20 is illustrated. As used herein, the term "air conditioning system" is intended to include a heating, ventilation and air conditioning (HVAC) system and/or a refrigeration system including both single unit and split package systems. As shown, the portion of the air conditioning system 20 includes a heat exchanger 22 having at least one heat exchanger coil 24. In an embodiment, the heat exchanger 22 may be configured as an evaporator within the air conditioning system 20. It should be understood that embodiments where the heat exchanger is configured as a condenser are also contemplated herein.

In the illustrated, non-limiting embodiment, the heat exchanger 22 includes a plurality of heat exchanger coils 24 configured as a V-coil. However, it should be understood that a heat exchanger 22 having any number of coils 24, such as a single coil, or more than two coils for example, is within the scope of the disclosure. Further, in embodiments having multiple coils 24, it should be understood that coils 24 configured in an A-shape (see FIG. 2), a W-shape, an M-shape, or another suitable shape are also contemplated herein. The plurality of coils 24, may be fluidly coupled to one another, or alternatively, may be separate from one another.

The heat exchanger 22 may be any suitable type of heat exchanger configured to transfer heat between a refrigerant and air or another medium. For example, the heat exchanger 22 may include one or more coils of thermally conductive material, such as copper, aluminum, alloys thereof, or combinations thereof. In other embodiments, the heat exchanger 22 may be a shell-and tube heat exchanger, a printed circuit heat exchanger, a plate-fin heat exchanger, a microchannel heat exchanger, or any combination thereof.

A movement mechanism 26, such as a fan or blower for example, is configured to move a cooling medium, such as a flow of air A for example, across the one or more coils 24 of the heat exchanger 22. Although the movement mechanism 26 is illustrated as being disposed vertically above the heat exchanger 22, and therefore in a draw-through configuration, it should be understood that embodiments where the movement mechanism 26 is positioned in a blow-through configuration, such as a blower 26 disposed vertically beneath a furnace 28 operably coupled to the heat exchanger 22 (see FIG. 2) for example, are also within the scope of the disclosure. Although a residential air conditioning system 20 is illustrated in FIG. 2, it should be understood that the heat exchanger illustrated and described herein may also be used in a commercial air conditioning system, such as shown in FIG. 3 for example.

Figure 2:
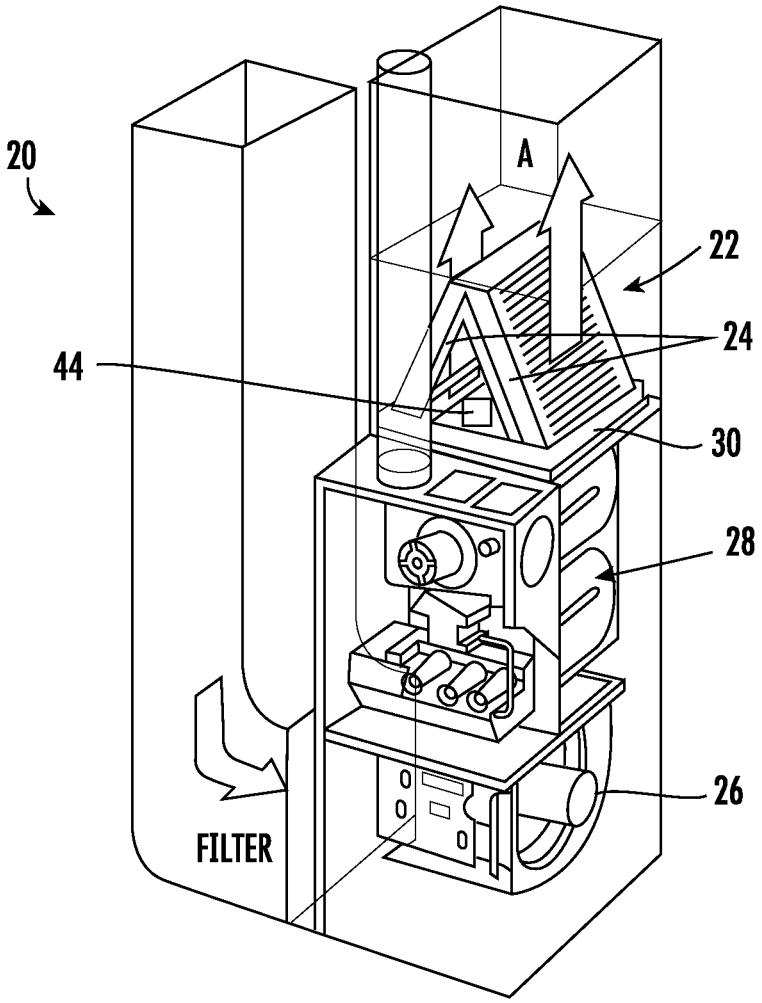
FIG. 2 is a perspective view of a portion of an air conditioning system including a heat exchanger according to an embodiment.
Figure 3:
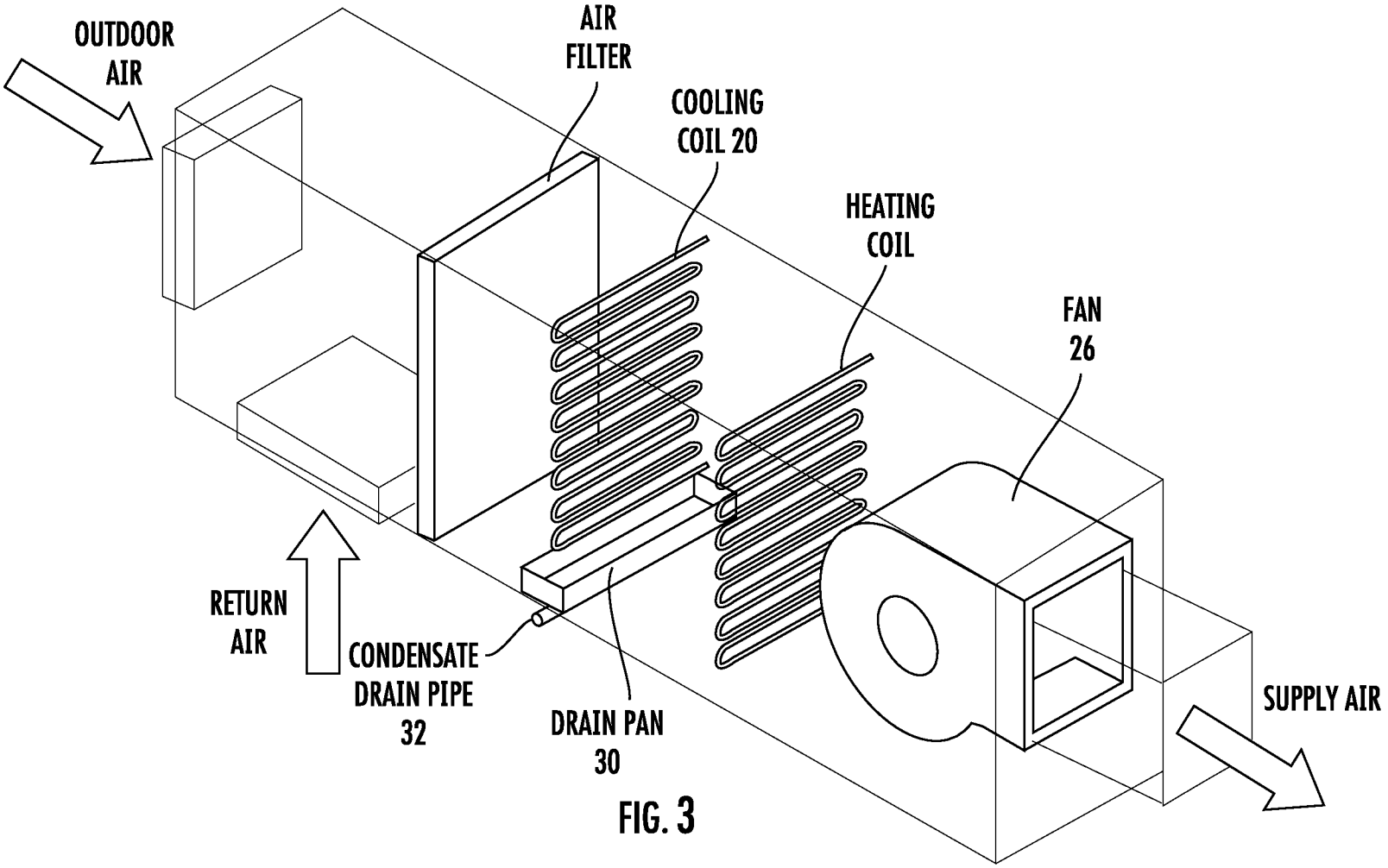
FIG. 3 is a perspective view of an air conditioning system including a heat exchanger according to an embodiment.
Figure 4:
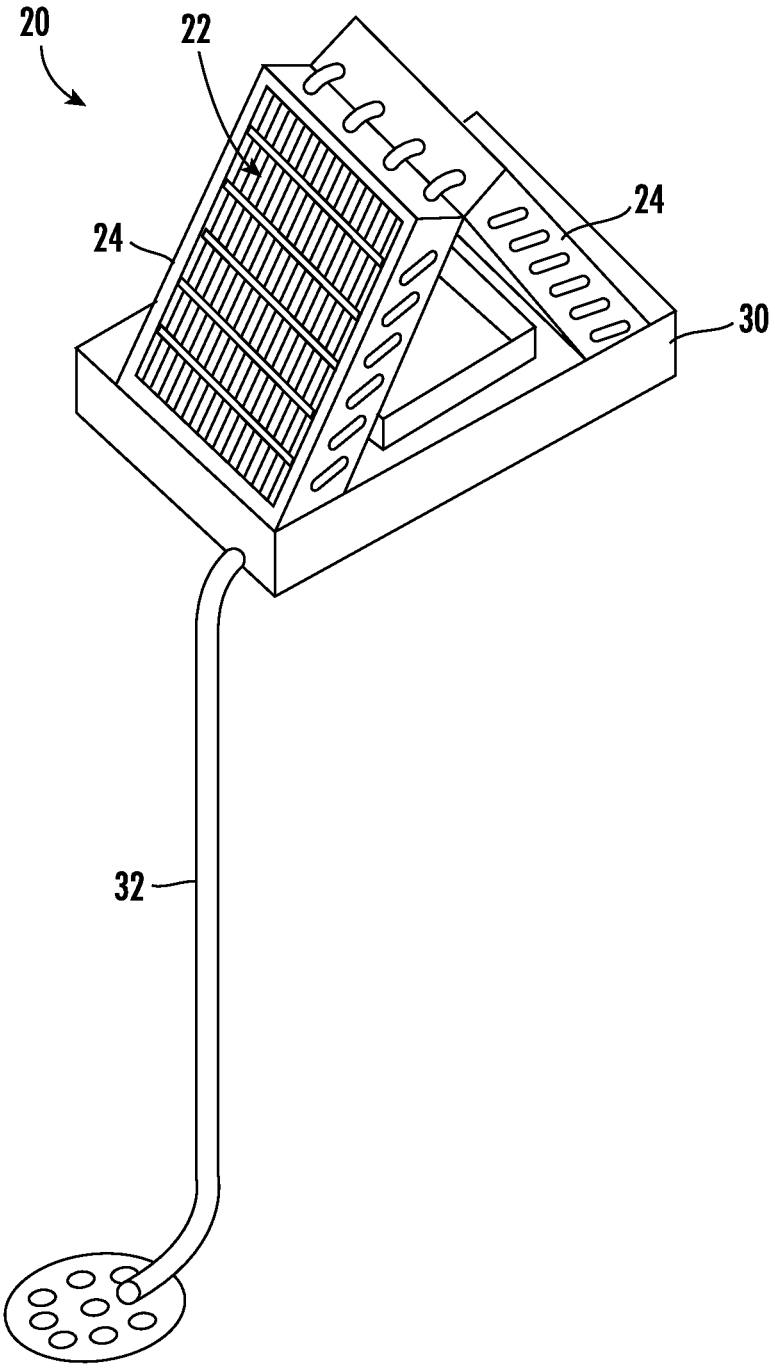
FIG. 4 is a detailed perspective view of a heat exchanger and a condensate drain pan according to an embodiment.

With continued reference to FIGS. 1-3, and further reference to FIG. 4, disposed vertically beneath the heat exchanger 22 is a condensate drain pan 30. The drain pan 30 is configured to capture or collect condensation that accumulates on and/or drips from the one or more heat exchanger coils 24 of the heat exchanger 22. One or more conduits or channels 32 fluidly coupled to or formed in the drain pan 30 are configured to direct the condensate collected within the drain pan 30 outside of the air conditioning system 20 or to another component within the air conditioning system 20.

With continued operation of the air conditioning system 20, dirt, debris, and other particles may collect on the exterior surface of the heat exchanger 22, such as between the fins of the or more heat exchanger coils 24, thereby blocking, at least partially, the flow path through or across the heat exchanger 22. As this particulate matter accumulates and clogs the flow path, the heat transfer between the refrigerant within the heat exchanger 22 and the air A is hindered, thereby lowering the efficiency of the air conditioning system 20. In instances where no or minimal particulate matter is present on the heat exchanger 22, the condensate that falls from the heat exchanger 22 to the drain pan 30 is primarily water having a generally neutral pH level. However, as the particulate matter accumulates on the heat exchanger 22, the condensate that drips from the heat exchanger 22 to the drain pan 30 is a mixture of water and the particulate matter. As a result, the pH level of the condensate within the drain pan 30 will change due to the presence of the particulate matter therein.

Figure 5:
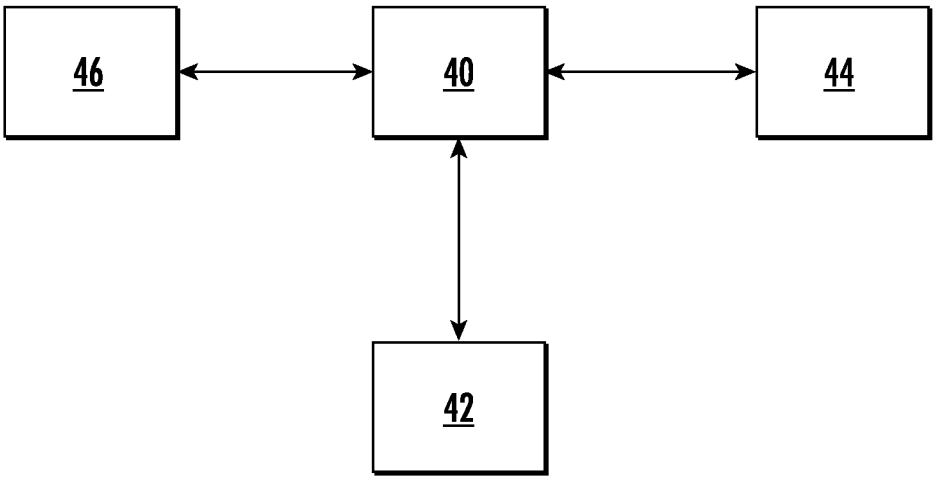
FIG. 5 is a schematic diagram of a control system of an air conditioning system according to an embodiment.

With reference now to FIG. 5, the air conditioning system 20 includes a controller 40 having one or more of a microprocessor, microcontroller, application specific integrated circuit (ASIC), or any other form of electronic controller known in the art. The controller 40 is operably coupled to one or more components of the air conditioning system 20, such as the movement mechanism 26 or a compressor (not shown) for example, to control operation thereof. A thermostat 42 for selecting a temperature demand of the area to be conditioned by the air conditioning system 20 is arranged in communication with the controller 40. In an embodiment, the controller 40 is configured to control operation of the air conditioning system 20 in response to the temperature setting of the thermostat 42.

In an embodiment, the air conditioning system 20 additionally includes at least one sensor 44 operable to automatically monitor a pH level of the condensate within the drain pan 30. The sensor 44 may be mounted directly within the condensate drain pan 30 or within a conduit fluidly coupled to the drain pan 30. Alternatively, the sensor 44 may be mounted at any other suitable location, including at a location external to air conditioning system 20 where condensate is collected, such as the condensate line or drain pipe 32 for example. The sensor 44 may be configured to continuously monitor and communicate the pH level of the condensate to the controller 40, or alternatively, may be configured to intermittently monitor and communicate the pH level of the condensate to the controller 40.

In response to a signal from the pH sensor 44, the controller 40 may be configured to evaluate a condition of the heat exchanger 22, such as the blockage of the flow across or through the fins of the heat exchanger 22. In an embodiment, the pH level is compared to at least one threshold. If the sensed pH level is above a first threshold, such as above a pH level of 6 for example, the controller 40 may be configured to determine that the heat exchanger 22 is in an acceptable condition. In such embodiments, the air conditioning system 20 will continue to operate normally.

However, if the sensed pH level is below the first threshold, the pH level may indicate that particulate matter has accumulated on the heat exchanger 22. In such instances, the controller 40 may be configured to indicate a need for service. The indicator may be associated with a component of the air conditioning system 20 that is visible by a user. For example, the controller 40 may display a message on the thermostat that service of the air conditioning system 20, and in some embodiments heat exchanger 22, is required. In another embodiment, the controller 40 may operate an indicator associated with a component of the air conditioning system 20 that is typically visible by a service man during a maintenance operation. For example, the controller 40 may energize a light that indicates to the service man that maintenance of the heat exchanger 22 is required.

The controller 40 may alternatively or additionally be configured to either directly or indirectly place a request for service. In an embodiment, the controller 40 is able to communicate with a remote system, such as a cloud-based system (illustrated schematically at 46) for example, the need for service. Based on the sensed pH level, the controller 40 will determine the urgency of the service. For example, if the sensed pH level is below a second threshold, the controller 40 may be configured to request immediate service of the air conditioning system 20. The second threshold may correspond to instances when the air flow at the heat exchanger 22 is reduced by at least 50%. However, it should be understood that any suitable threshold is within the scope of the disclosure.

In embodiments where the sensed pH level is between the first threshold and the second threshold, the controller 40 may determine an approximate date by which service is required in the future. In an embodiment, the future service date is based on an estimation of when the pH level of the particulate matter will fall below the second threshold.

Alternatively, or in addition, a service man may be able to manually determine a condition of the heat exchanger 22 without actually seeing the heat exchanger 22. In an embodiment, during a maintenance operation, a service man will measure the pH level of the condensate within the condensate drain pan 30 using a commercially available standard pH test strip, a pH meter, and/or a colorimeter. The service man will then compare the pH level indicated by the test strip to a correlated table, which will identify a condition of heat exchanger 22 and whether maintenance of the heat exchanger, specifically cleaning of the debris accumulated of the exterior of the heat exchanger 22, is required. In an embodiment, the service man may perform maintenance in response to the condition of the heat exchanger 22. However, in other embodiments, the table may indicate or suggest a future date by which maintenance of the heat exchanger 22 should be performed.

Monitoring of the pH level of the condensate of a heat exchanger 22, such as an evaporator for example, provides a cost effective mechanism for accurately indicating the condition of the particulate matter accumulated on the evaporator. By actively identifying clogging, maintenance of the heat exchanger can be expedited, thereby minimizing the wear and tear on the remainder of the air conditioning system 20, and reducing the operating costs of the air conditioning system 20.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method for evaluating a heat exchanger of an air conditioning system comprising:

measuring a pH level of a condensate of the heat exchanger via a sensor;

communicating the pH level of the condensate from the sensor to a controller;

comparing, via the controller, the pH level of the condensate measured by the sensor to a first threshold to evaluate a condition of the heat exchanger; and in response to the pH level being less than the first threshold, determining that the heat exchanger has a flow blockage.

2. The method of claim 1, further comprising operating an indicator in response to the pH level to indicate a need for service.

3. The method of claim 2, wherein the indicator is associated with a thermostat of the air conditioning system.

4. The method of claim 1, wherein the sensor is a pH sensor, and measuring the pH level of the condensate of the heat exchanger is performed automatically by a pH sensor.

5. The method of claim 4, further comprising:

comparing the pH level to a second threshold in response to determining that the pH level is less than the first threshold.

6. The method of claim 5, wherein in response to determining that the pH level is less than or equal to the second threshold, communicating with a remote system a need for immediate service.

7. The method of claim 5, wherein in response to determining that the pH level is between the first threshold and the second threshold, estimating a date by which service will be required.

8. The method of claim 1, wherein measuring the pH level of the condensate of the heat exchanger is performed manually.

9. The method of claim 8, wherein measuring the pH level of the condensate is performed using one of a pH test strip, a pH meter, and a colorimeter.

10. The method of claim 8, wherein determining the condition of the heat exchanger in response to the pH level further comprises comparing the pH level to a correlated table.

11. An air conditioning system comprising:

a heat exchanger;

a pH sensor operable to monitor a pH level of a condensate from the heat exchanger; and a controller configured to:

receive the pH level of the condensate from the pH sensor; and compare the pH level to at least one threshold; and in response to determining that the pH level is less than the at least one threshold, determining that the heat exchanger has a flow blockage.

12. The air conditioning system of claim 11, further comprising a condensate drain pan disposed vertically beneath the heat exchanger.

13. The air conditioning system of claim 12, wherein the pH sensor is arranged within the condensate drain pan.

14. The air conditioning system of claim 11, wherein the controller is further configured to operating an indicator in response to the pH level to indicate a need for service.

15. The air conditioning system of claim 11, wherein the controller is further configured to communicate a need for immediate maintenance.

* * * * *